United States Patent [19]

Eggert, Jr.

[11] Patent Number: 4,487,133

[45] Date of Patent: Dec. 11, 1984

[54] PRIMARY SUSPENSION SYSTEM FOR PROVIDING LOW VERTICAL AND LONGITUDINAL SPRING RATES IN A RAILWAY CAP

[75] Inventor: Walter S. Eggert, Jr., Huntington Valley, Pa.

[73] Assignee: The Budd Company, Troy, Mich.

[21] Appl. No.: 425,034

[22] Filed: Sep. 24, 1982

[51] Int. Cl.[3] ..... B61F 5/30

[52] U.S. Cl. ..... 105/224.1; 267/3; 267/153; 308/38

[58] Field of Search ..... 105/218 R, 220, 221 R, 105/222, 223, 224 R, 224.1; 267/3, 153; 308/38

[56] References Cited

U.S. PATENT DOCUMENTS

| | | | |
|---|---|---|---|
| 1,825,530 | 9/1931 | Latshaw | 105/224 R X |
| 1,932,445 | 10/1933 | Burns | 105/224.1 X |
| 2,197,110 | 4/1940 | Muchnic | 105/222 X |
| 3,720,175 | 3/1973 | Russell-French | 105/224.1 |
| 3,945,327 | 3/1976 | Henricot | 105/224.1 |
| 4,044,689 | 8/1977 | Eggert, Jr. | 105/221 R |
| 4,237,791 | 12/1980 | Jackson et al. | 105/224.1 X |

FOREIGN PATENT DOCUMENTS

| | | | |
|---|---|---|---|
| 2326729 | 12/1974 | Fed. Rep. of Germany | 105/224.1 |
| 825955 | 12/1937 | France | 105/218 R |
| 1037298 | 7/1966 | United Kingdom | 105/224.1 |
| 1058443 | 2/1967 | United Kingdom | 105/221 |

*Primary Examiner*—David A. Scherbel
*Assistant Examiner*—David F. Hubbuch

[57] ABSTRACT

A primary suspension spring disposed between a wheel journal and a railway truck side frame includes top and bottom elastomeric members which form a ring around the journal. Both members include a relatively large cut-away portion towards their centers to provide soft vertical and longitudinal spring rates for a car body. Relatively small amounts of elastomeric material are disposed longitudinally towards the front and rear of the large cut-away portions towards the tangents of the wheel journal.

1 Claim, 5 Drawing Figures

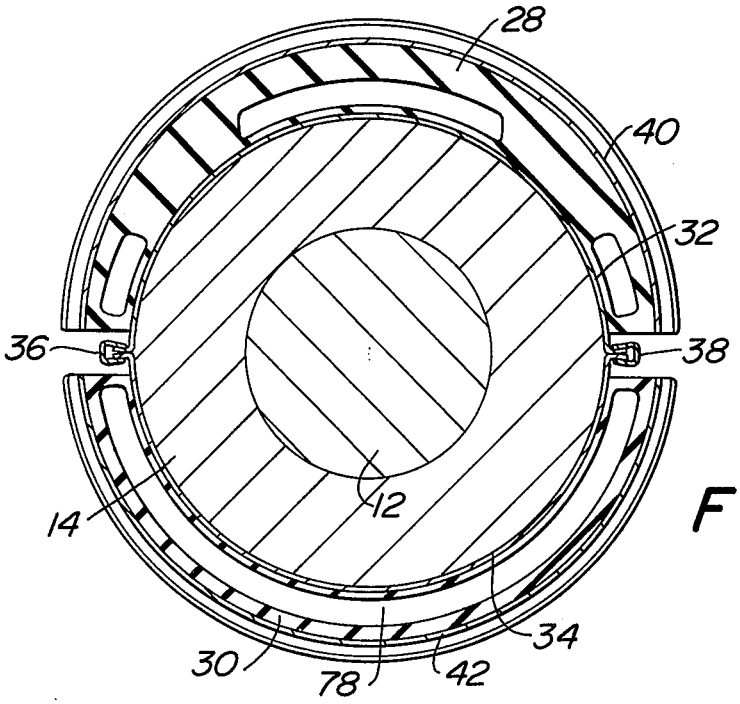
FIG. 4
FIG. 5
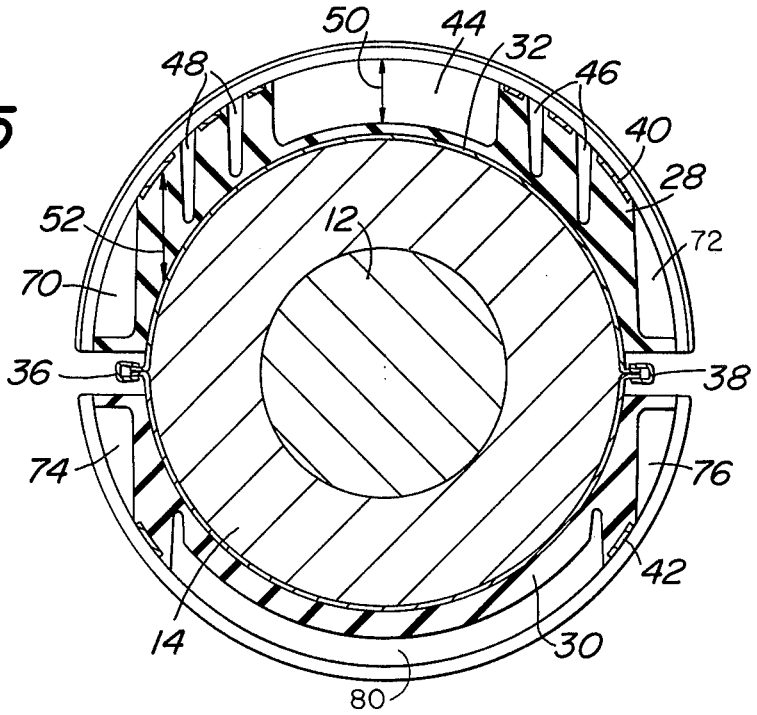

PRIMARY SUSPENSION SYSTEM FOR PROVIDING LOW VERTICAL AND LONGITUDINAL SPRING RATES IN A RAILWAY CAP

BACKGROUND OF THE INVENTION

An example of a primary suspenion system may be found in copending patent application entitled "Primary Suspension System for a Railway Car", U.S. Pat. No. 4,444,122, issued Apr. 24, 1984, assigned to the same assignee as the present invention.

There are presently in use railway cars in which the primary suspension system includes rubber, or other elastomeric material, so called shock rings fitted around the journal bearing assemblies between the bearing assemblies and the side frames of the truck. The rubber rings are compressed and clamped between the journals and side frames. Because of the arrangement used, very high vertical and longitudinal stiffnesses result, in the order of about 100,000 pounds per inch.

Relatively high vertical stiffness in the primary suspension systems results in very little attenuation of the wheel accelerations to the truck frame. The relatively high longitudinal stiffness tends to maintain the axle positions or wheel bases within the truck frame.

Tests have indicated that reducing the vertical stiffness in the primary suspension systems reduces the accelerations transmitted from the wheels to the truck frame. This tends to increase the useful life of the truck mounted equipment.

Tests have also indicated that reducing the longitudinal stiffness in the primary suspension system permits the axles on the truck to assume a more radial position with respect to the tracks when making turns. This reduces the angle of attack of the wheel flanges with respect to the tracks thereby reducing lateral wheel forces. The result is reduction of wheel and flange wear and longer life.

The aforementioned application discloses a primary suspension system including rubber rings disposed between wheel journal bearing assemblies and the side frame of a railway truck. The rubber rings have cut-away portions or openings therein bonded to inner and outer split metal rings. The openings in the rings provide relatively low spring rates for the suspension system.

While the suspension system of the aforementioned application is satisfactory, it is sometimes desirable to provide still softer spring rates in the vertical and longitudinal directions while maintaining a relatively high lateral spring rate. In the aforementioned application and other primary suspenion systems used heretofore, the elastomeric materials forming the springs were directly above the axles to support the weight of the car body. Consequently, the material was greatly compressed within a relatively short distance thereby limiting the amount of vertical and longitudinal spring rates.

OBJECTS OF THE INVENTION

It is an object of this invention to provide an improved soft primary suspension system in a limited space while providing controlled spring rates longitudinally, laterally and vertically.

BRIEF SUMMARY OF THE INVENTION

In accordance with the present invention an elastomeric primary suspension spring is disposed between each of the wheel journals and side frame of a truck which supports a railway car body. A pair of elastomeric members include top and bottom halves which form a ring clamped around each of the wheel journals. The top element includes a relatively large cut-away portion towards its center directly over the wheel journal to provide soft vertical and longitudinal spring rates. A plurality of relatively narrow cut-away portions are disposed longitudinally towards the front and rear of the large cut-away portion of the top elements towards the tangents of the wheel journal. The lower element also includes a relatively large cut-away portion disposed below the wheel journal with at least one relatively small cut-away portion disposed longitudinally towards the front and rear of the relatively large cut-away portion towards the tangents of the wheel journal.

Other objects and advantages of the present invention will be apparent and suggest themselves to those skilled in the art, from a reading of the following specification and claims, taken in conjunction with the accompanying drawings.

BRIEF DESCRIPTION OF THE DRAWINGS

FIG. 4 is a cross-sectional view taken along lines 4—4 of FIG. 3; and FIG. 5 is a cross-sectional view taken along lines 5—5 of FIG. 3.

DESCRIPTION OF THE INVENTION

Figure 1:
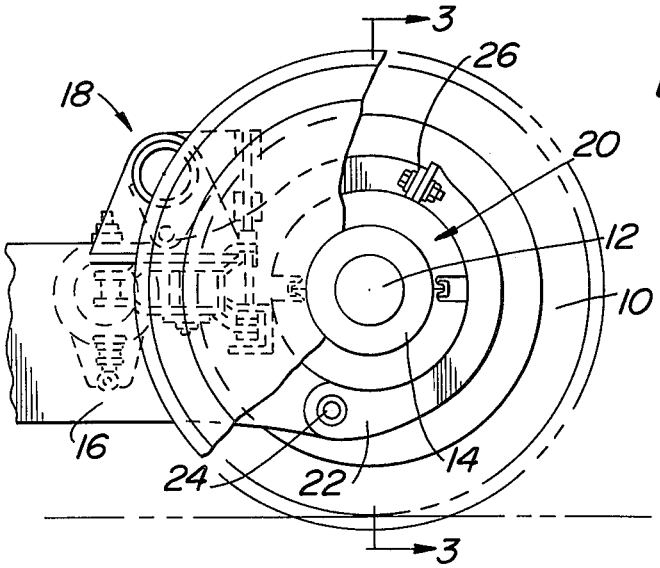
FIG. 1 is a side view illustrating a portion of a truck with a primary suspension system, in accordance with the present invention.
Figure 2:
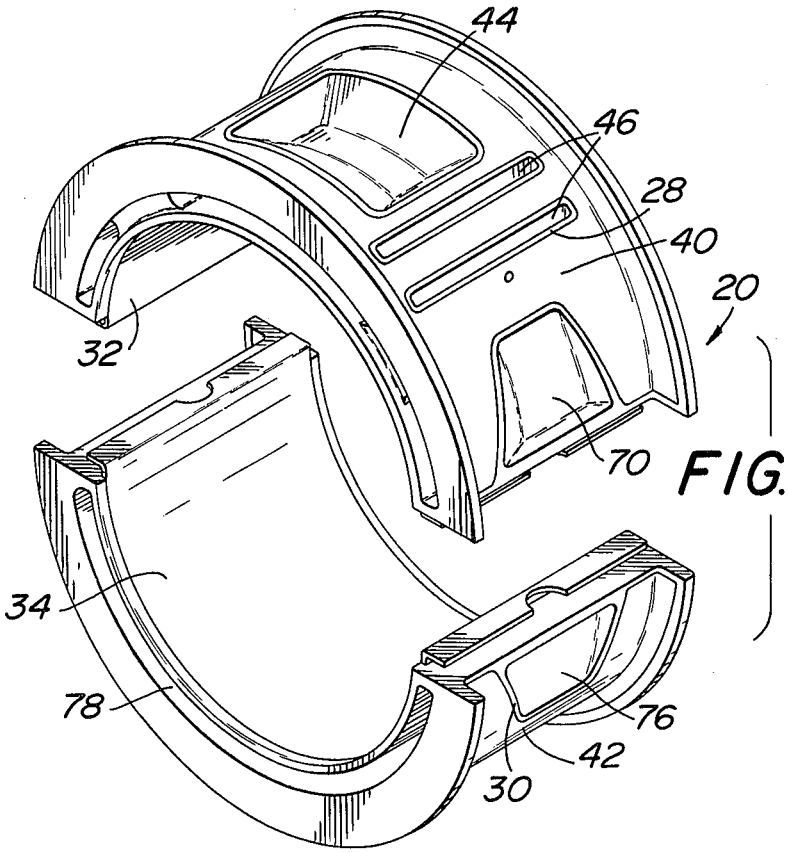
FIG. 2 is an isometric broken-away view of a primary suspension system illustrating the present invention.

Only a single wheel-axle assembly, journal bearing assembly and primary suspension system is illustrated in FIG. 1, it being understood that a conventional truck would include four such similar type wheel-axle assemblies with four primary suspension systems.

Referring to FIG. 1, a wheel axle unit includes a wheel 10 secured to an axle 12. A wheel journal bearing assembly 14 is disposed around the axle 12. The wheel-axle unit comprising the wheel 10 and axle 12 are secured to a side frame 16. Two side frames connected by a bolster often comprise a conventional truck. Various other parts of the truck, not illustrated, are designed to hold other equipment, such as braking units and other similar apparatus 18 not related to the present invention. A primary suspension system 20 is disposed between the journal bearing assembly 14 and the side frame 16 and is the subject of the present invention.

The wheel-axle assembly, including the wheel 10 and axle 12, is held to the side frame 16 by means of a clamp 22 adapted to be pivoted about a pin 24. The clamp 22, after receiving the wheel-axle assembly with the primary suspension 20, is moved to a locked position and held secured to the frame by means of locking means 26 which may include a conventional head bolt, washer and lock nut.

Referring to FIGS. 2–5, along with FIG. 1, the primary suspension system 20 includes top and bottom half member 28 and 30 which form a ring configuration around the journal bearing 14. The members 28 and 30 comprise elastomeric members having their inner surfaces bonded to inner metal half frames or plates 32 and 34, respectively, each including projecting edges extending outwardly therefrom. A pair of clips 36 and 38 are attached over the projecting edges of the inner plates 32 and 34 to hold the bonded members 28 and 30 together to form the ring configuration prior to attachment to the side frame.

The top and bottom elastomeric members 28 and 30 have their outer surfaces bonded to outer frames or plates 40 and 42, respectively. Open areas may sometimes be provided in the outer plates 40 and 42 which coincide with the open areas in the elastomeric members 26 and 28 to be described.

Basically, the primary suspension system of the present invention involves having the main support material within the two half elastomeric members 28 and 30 away from their longitudinal centers and locating it towards the tangents of the wheel journal 14 and axle 12. The top member 28 generally provides more design problems than the bottom member 30 because it directly supports the load of a car body.

The top half elastomer member 28 includes a centrally disposed relatively large cut-away area 44. A pair of relatively narrow cut-away areas 46 are disposed forwardly away from the area 44 and a pair of relatively narrow cut-away areas 48 are disposed rearwardly from the area 44. The area 44 is centrally disposed over the center axis of the journal bearing and axle, whereas the areas 46 and 48 are disposed longitudinally forwardly and rearwardly towards the tangents of the journal bearing 14 and axle 12.

With respect to the vertical forces applied to the top elastomeric member 28, there is very little support material at its center in the area 44. Therefore, very little vertical resistance is offered and a very soft spring rate is provided.

The principal supporting material in the member 28 is provided at the tangents of the journal and axle. These are the portions of the material which go into compression during vertical deflections. Reference is made to a set of lines 50 and 52 which include arrows thereon as illustrated in FIG. 5.

The distance represented by the line 52 is about twice as long as the distance represented by the line 50. The line 52 is in the area of the support material of the elastomeric member 28 whereas the line 52 is in the cut-away or void area 44. This arrangement makes it possible to obtain almost twice the deflection of the elastomeric material for the same amount of strain. This in turn provides a very soft primary suspension system.

The plurality of relatively narrow cut-away portions 46 and 48 provide control for the compression rate. Generally, the compression rate is a function of the bulge area constraint. If a single block of elastomeric material were used, the compression would cause bulging on both sides of the block. With a number of smaller blocks, however, each of the smaller blocks can bulge individually. When this is done, as in the present invention, a much softer spring rate is possible.

The closer the cut-away portions 46 and 48 are placed towards the tangencies of the journal and axle, the softer will be the primary suspension. Depending on how much elastomeric material is provided over the clips 36 and 38, moving the cut away portions 46 and 48 closer to the front and rear tangents of the journal and axle could eventually put the elastomeric material in shear and result in an extremely soft suspension. However, this is avoided because it is desirable in the present invention to provide softness in both the longitudinal and vertical directions.

The member 28 works on a compression axis as well as on the shear axis. The shear axis, i.e. the longitudinal direction, is made very soft by the open areas 44, 46 and 48. Consequently, in the present embodiment of the invention, a very soft spring rate is provided in the longitudinal direction and a moderately soft spring rate is provided in the vertical direction. As previously mentioned, a soft longitudinal spring rate tends to permit some self steering which diminishes wheel and flange wear. The soft vertical spring rate reduces the impact of the wheels on the rail thereby improving the life of the wheels.

Figure 3:
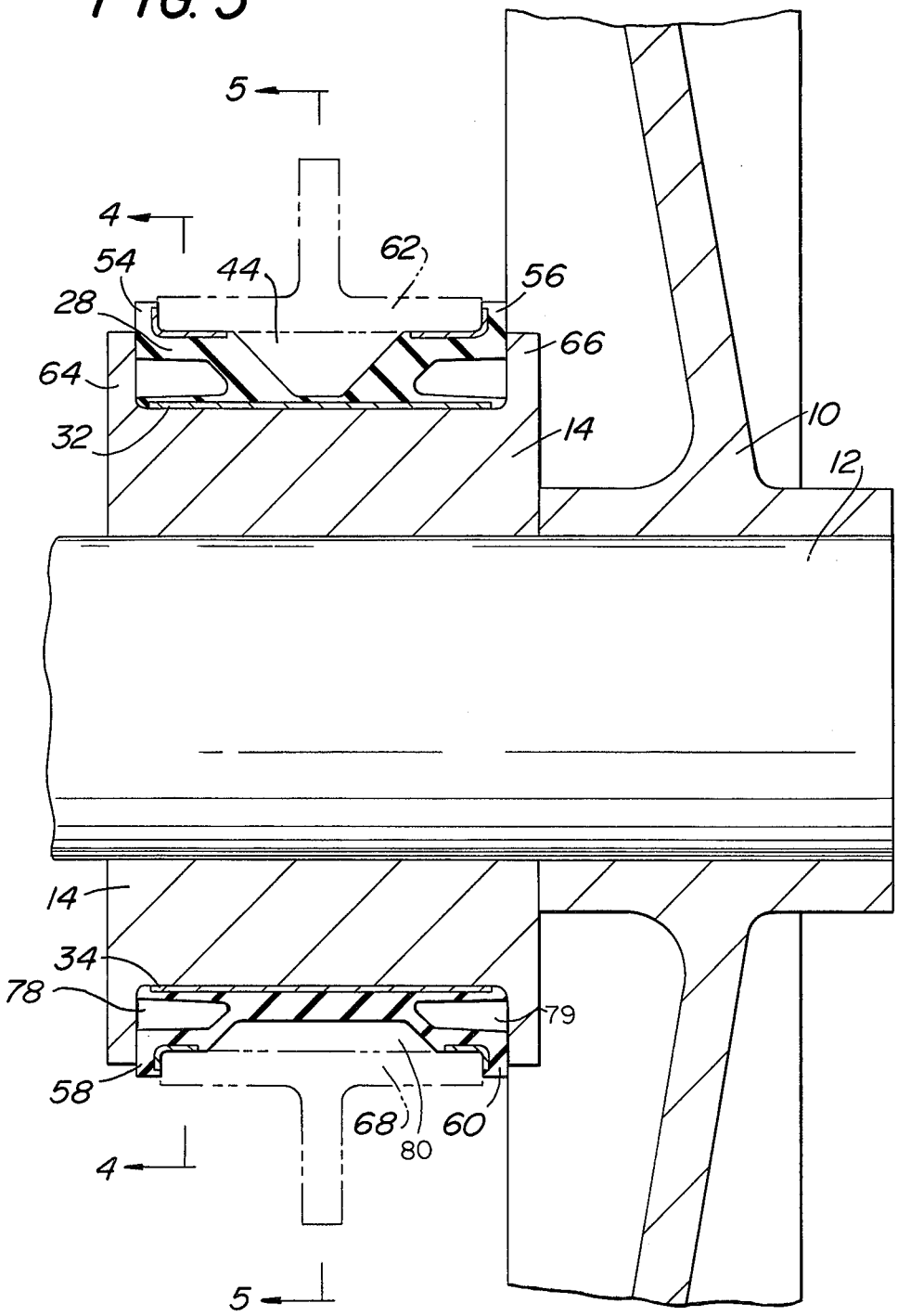
FIG. 3 is a cross-sectional view taken along lines 3—3 of FIG. 1.

As illustrated in FIGS. 3 and 5, the cut-away area 44 of the member 28 is oriented in an angular axis shaped somewhat like a top of a "V". The elastomeric material on either side of the open area operates in shear when it is compressed. This further adds to the softness of the vertical spring rate.

The bottom member 30 is also made soft for vertical downward movements. The loading on this member comes more from the axle 12 rather than from the load of the car body. However, enough elastomeric material must be provided in the lower member 30 to provide good lateral stiffness, to be discussed. The longitudinal stiffness of the lower member 30 is designed to be about the same as the top member 28. The lower member 30 includes cut-away areas 74 and 76, areas 78 and 79, and a relatively large cut-away portion 80 to minimize the vertical restraint. In general, the geometry of the lower member 30 is left almost completely open with only enough material around its periphery to provide good control of the lateral stiffness of the primary suspension system.

The cut-away areas 70 and 72 disposed rearwardly and forwardly from the area 44, as well as the areas 74 and 76 associated with the bottom members 30, further aid in the softness of the spring. The material adjacent these cut-away portions also provide support similar to the material between the pair of cut-away areas 46 and 48.

While the soft vertical and longitudinal spring rates are desired, it is also important to provide a relatively stiff spring laterally, i.e. provide a high lateral spring rate. FIG. 3 best illustrates how lateral restraint is achieved in the present invention.

Flanges 54 and 56 extend from the main top member 28. Flanges 58 and 60 extend from the bottom member 30. The flanges 54 and 56 provide constrictions between the ends of a downwardly extending portion 62 from the side frame 16 and upwardly extending flanges 64 and 66 of the wheel journal 14. In like manner, the flanges 58 and 60 are constrained by the flange 64 and 66 of the journal and the side ends of a bottom portion 68 of the side frame 16. As previously mentioned, further control is provided by bonding the members 28 and 30 to the metal half rings 32 and 34 rather than have the elastomeric material loosely disposed therebetween.

The present invention has therefore provided a primary suspension system with a controlled spring rate longitudinally, vertically and laterally. This is accomplished in a relatively limited space.

What is claimed is:

1. In a railway truck for supporting a car body and having a side frame for receiving a wheel-axle unit disposed to ride in a journal bearing having a pair of outwardly extending flanges, a primary suspension spring disposed between said side frame and said journal bearing comprising:

(a) top and bottom plate members;

(b) a pair of elastomeric members forming top and bottom half elements bonded to said top and bottom plate members disposed around the axle of said wheel-axle units;

(c) said top and bottom plate members including projecting edges extending therefrom to receive a pair of clips to secure together said top and bottom plate members;

(d) said top element includes a pair of upwardly extending flanges disposed between the flanges of said journal bearing and an upper portion of said side frame to provide lateral restraint of said top element;

(e) said bottom elements include a pair of downwardly extending flanges disposed between the flanges of said journal bearing on a lower portion of said side frame to provide lateral restraint of said bottom element without effecting the vertical and longitudinal spring rates of said pair of elastomeric members;

(f) said top element including a relatively large cut-away portion towards its center directly over said axle to provide soft vertical and longitudinal spring rates for said car body and a plurality of relatively narrow cut-away portions disposed longitudinally towards the front and rear of said large cut-away portion towards the vertical tangents of said axle to provide support for said car body;

(g) said relatively large cut-away portion of said top element includes a pair of angularly shaped elastomeric portions of material disposed laterally in said top element and extending in opposite outward directions, and further having open areas on both sides of said elastomeric portions whereby greater deflection is provided to accomplish a low spring rate within the constraints of the elastomeric material in said members; and (h) said bottom element including a second relatively large cut-away portion disposed below said axle with at least one relatively small cut-away portion disposed longitudinally towards the front and rear of said second relatively large cut-away portion towards the tangents of said axle.

* * * * *